United States Patent [19]

Ephithite

[11] 4,298,161

[45] Nov. 3, 1981

[54] CENTRIFUGE

[75] Inventor: Henry J. Ephithite, Camberley, England

[73] Assignee: Wilkinson Rubber Linatex Limited, Surrey, England

[21] Appl. No.: 85,989

[22] Filed: Oct. 18, 1979

[30] Foreign Application Priority Data

Oct. 23, 1978 [GB] United Kingdom ..... 41556/78

[51] Int. Cl.[3] ..... B04B 1/20; B04B 11/00

[52] U.S. Cl. ..... 233/7

[58] Field of Search ..... 233/7, 8, 21, 1 A, 1 E, 233/6, 16, 19 R, 22, 28, 34, 38, 45

[56] References Cited

U.S. PATENT DOCUMENTS

| | | | |
|---|---|---|---|
| 2,174,857 | 10/1939 | Jorgensen | 233/7 |
| 3,279,687 | 10/1966 | Amero | 233/7 |
| 3,428,248 | 2/1969 | Andresen | 233/7 |
| 3,532,264 | 10/1970 | Amero | 233/7 |
| 3,568,919 | 3/1971 | Nielsen | 233/7 |
| 3,575,709 | 4/1971 | Ferney | 233/7 |

FOREIGN PATENT DOCUMENTS

| | | |
|---|---|---|
| 456353 | 5/1935 | United Kingdom . |
| 539140 | 9/1940 | United Kingdom . |

*Primary Examiner*—Robert W. Jenkins

*Attorney, Agent, or Firm*—Birch, Stewart, Kolasch & Birch

[57] ABSTRACT

A centrifuge for separating a solids-liquid mixture comprises a rotatable drum (10) having an inner surface of revolution about the rotary axis of the drum, a solids discharge outlet (23) at one end of the drum and a liquid discharge outlet (26) at the other end of the drum. Means (32,37) are provided for feeding the solids-liquid mixture to a region adjacent the inner surface of the drum and a solids material conveyor (28) is arranged within the drum for rotation about the rotary axis of the drum at a speed slightly different from the speed of rotation of the drum. The conveyor (28) has a distal working surface formed about the rotary axis adjacent the inner surface of the drum and adapted to engage liquid-reduced solids material during rotation of the drum and the conveyor to convey it to the solids discharge outlet, while solids-reduced liquid discharges at the liquid discharge outlet at the other end of the drum. The distal working surface is provided at least in part by wear-resistant rubber material (43).

20 Claims, 6 Drawing Figures

CENTRIFUGE

SUMMARY AND OBJECTS OF THE INVENTION

The present invention relates to centrifuges for separating solids-liquid mixtures and is particularly, although not exclusively, concerned with a centrifuge for separating solids material from a slurry.

A slurry centrifuge in common use comprises a rotatable drum having an inner surface of revolution about the rotary axis of the drum, a solids discharge outlet at one end of the drum and a liquid discharge outlet at the other end of the drum. Means are provided for feeding the slurry to a region adjacent the inner surface of the drum and a solids material screw conveyer is arranged within the drum for rotation about the rotary axis of the drum at a speed slightly different from the speed of rotation of the drum. The conveyer is provided with a helical blade which forms a working surface adjacent the inner surface of the drum and which is adapted to engage the liquid-reduced solids material during rotation of the drum and the conveyer to convey it to the solids discharge outlet, the solids-reduced liquid discharging at the liquid discharge outlet at the other end of the drum.

In a slurry centrifuge hitherto proposed, the working surface of the screw is of metal and is subject to abrasion by contact with the solids material of the slurry and to corrosion by the liquid of the slurry. As a result frequent replacement is necessary. While proposals have been made for improving blade replacement techniques, a welding operation is required, which is time consuming and makes removal and replacement of the blades difficult.

It is an object of the present invention to provide a slurry centrifuge in which the problem of blade wear is mitigated.

According to the present invention, there is provided a centrifuge for separating a solids-liquid mixture comprising a rotatable drum having an inner surface of revolution about the rotary axis of the drum, a solids discharge outlet at one end of the drum and a liquid discharge outlet at the other end of the drum. Means are provided for feeding the solids-liquid mixture to a region adjacent the inner surface of the drum. In addition a solids material conveyer is arranged within the drum for rotation about the rotary axis of the drum at a speed slightly different from the speed of rotation of the drum and having a distal working surface formed about the rotary axis adjacent the inner surface of the drum and adapted to engage liquid-reduced solids material during rotation of the drum and the conveyer to convey it to the solids discharge outlet while solids-reduced liquid discharges at the liquid discharge outlet at the other end of the drum, the distal working surface being provided at least in part by wear-resistant rubber material.

Preferably, the distal working surface on the conveyer extends helically about the rotary axis. The conveyer may take the form of a screw conveyer with the distal working surface being formed by the surface of the screw blade facing the end of the drum provided with the solids discharge outlet. The screw blade may comprise a metal root portion and a strip of the wear-resistant rubber material mounted on the root portion so as to present a working surface facing the end of the drum provided with the solids discharge outlet.

In an embodiment of the invention, the strip of wear-resistant rubber material extends radially beyond the end of the root portion and terminates adjacent the inner surface of the drum. The strip may be of generally rectangular cross-section with one of the longitudinal edges of the strip being formed with a step extending along the strip and having a height and depth normal to the length of the strip equal to the thickness and height of the root portion of the screw blade, the strip being so mounted on the root portion that the root portion fits into the step throughout the length of the strip.

The means for feeding the solids-liquid mixture to the interior surface of the drum advantageously comprises a feed duct having a radial feed duct portion rotatable with the conveyer and extending from the rotary axis of the conveyer to an outlet at the outer surface of the conveyer and an axial feed duct portion communicating with and extending along the rotary axis of the conveyer from the radially inner end of the radial feed duct portion to an open end outside the conveyer. The axial feed duct portion in a preferred embodiment of the invention is rotatable with the conveyer and the open end thereof communicates with a non-rotatable feed inlet. The non-rotatable feed inlet includes two non-rotatable annular seals of a wear-resistant rubber material surrounding the axial feed duct portion and engaging the outer surface thereof at axially spaced locations therealong adjacent the open end of the axial feed duct portion to form an annular chamber between the two seals. A means is provided for feeding to the chamber water under pressure, whereby water seeps between the ends of the seals and the outer surface of the axial feed duct portion to lubricate the seals and to prevent the passage of the solids-liquid mixture beneath the seals.

The radially inner end of each seal may bear against a non-rotatable annular ring, the radially inner edge of which is spaced from the outer surface of the axial feed duct portion thereby to control the rate of seepage of water beneath the seals, the outer peripheries of the rings being connected to the non-rotatable feed inlet, which surrounds the open end of the axial feed duct portion. One or each of the rings may be axially adjustable to vary the rate of water seepage beneath the associated seal. Means may also be provided for feeding to the feed inlet a flocculent for mixing with the solids-liquid mixture before it enters the axial feed duct portion.

In slurry centrifuges hitherto proposed, it has been the practice to drive the drum from a drive motor and transmit this drive with an appropriate speed differential to the conveyer using a gear box. It has however been found that the gear box requires frequent attention and in an alternative arrangement according to an embodiment of the present invention, the drum is fixedly mounted on a drive shaft coaxial with the rotary axis of the drum, the drum is driven by drive means through a drive belt drivingly engaging a pulley fixedly mounted on the drive shaft, the conveyer is likewise fixedly mounted on a drive shaft coaxial with the rotary axis of the conveyer and is arranged to be driven by the drive means through a further drive belt drivingly engaging a further pulley on the drive shaft of the conveyer. The drive belts are tensioned by jockey pulleys.

The drum in the preferred embodiment of the invention includes a right cylindrical portion connected to a frusto-conical portion which converges toward the rotary axis as it extends away from the right cylindrical portion, the liquid discharge outlet being provided at the outer end of the right cylindrical portion and the solids material discharge outlet being provided at the outer end of the frusto-conical portion.

BRIEF DESCRIPTION OF THE DRAWINGS

One embodiment of the invention will now be described by way of example with reference to the accompanying drawings in which.

DETAILED DESCRIPTION OF THE INVENTION

Figure 1:
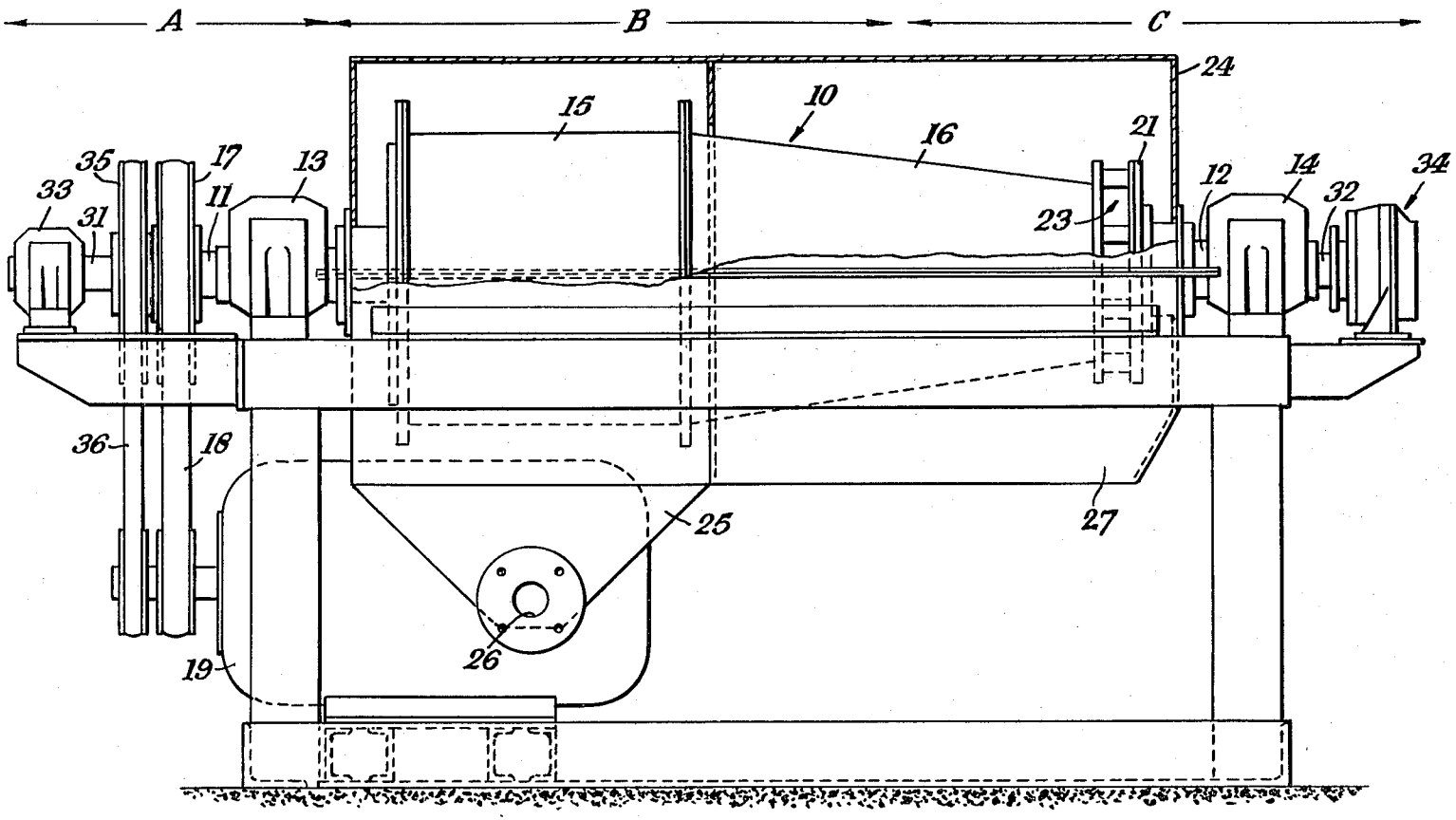
FIG. 1 is a side elevation of a slurry centrifuge according to the invention.
Figure 3:
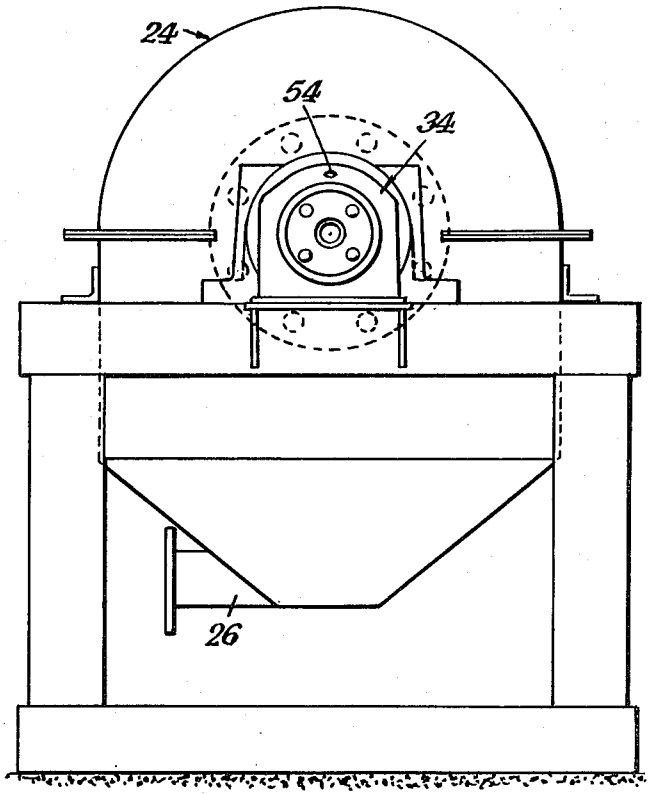
FIG. 3 is an end elevation of the centrifuge shown in FIG. 1, viewed from the right in FIG. 1.
Figure 2:
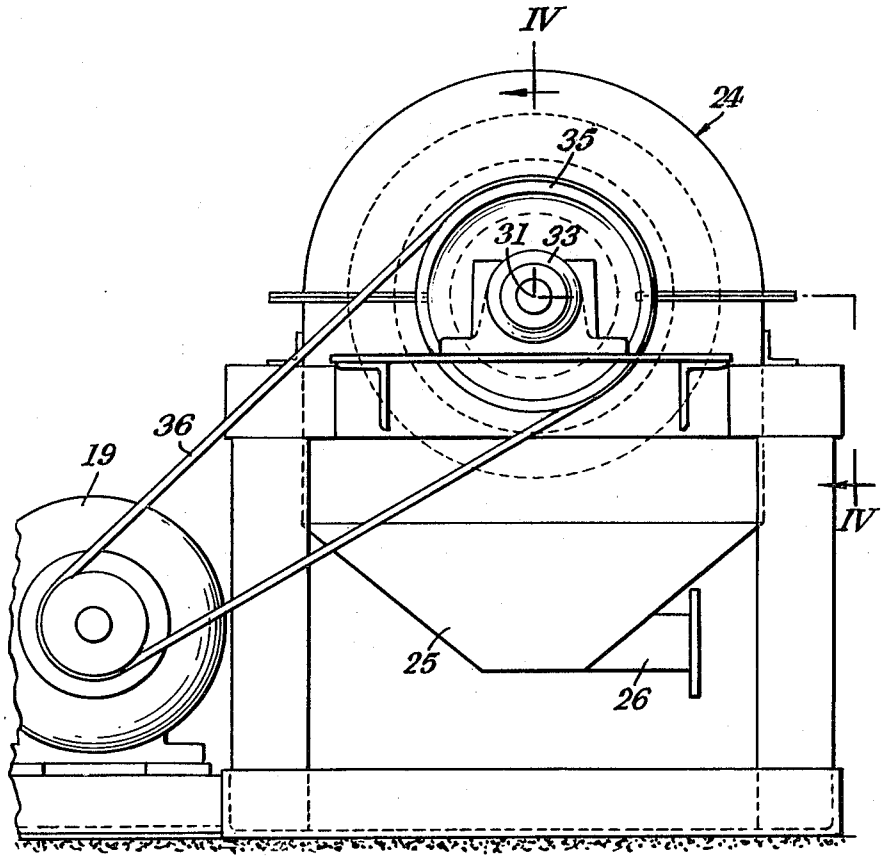
FIG. 2 is an end elevation of the centrifuge shown in FIG. 1 viewed from the left in FIG. 1.
Figure 4A:
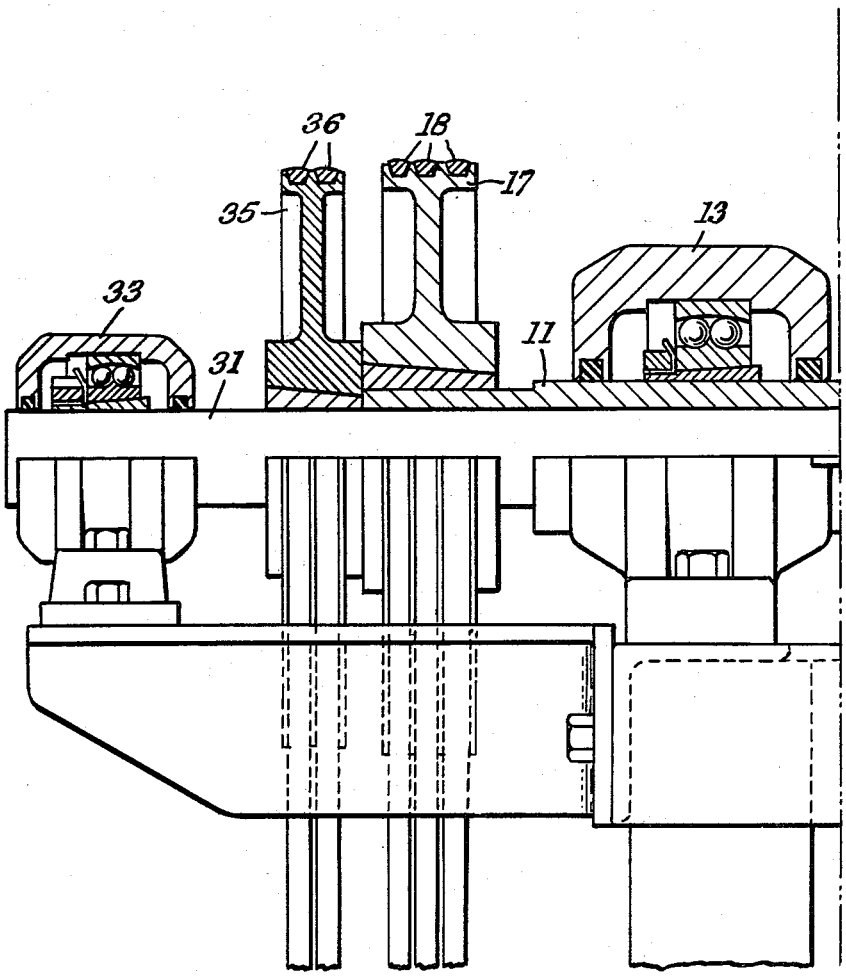
FIG. 4A is a part sectional side elevation drawn to an enlarged scale of a portion A of the conveyer shown in FIG. 1, taken on the line IV—IV in FIG. 2.
Figure 4B:
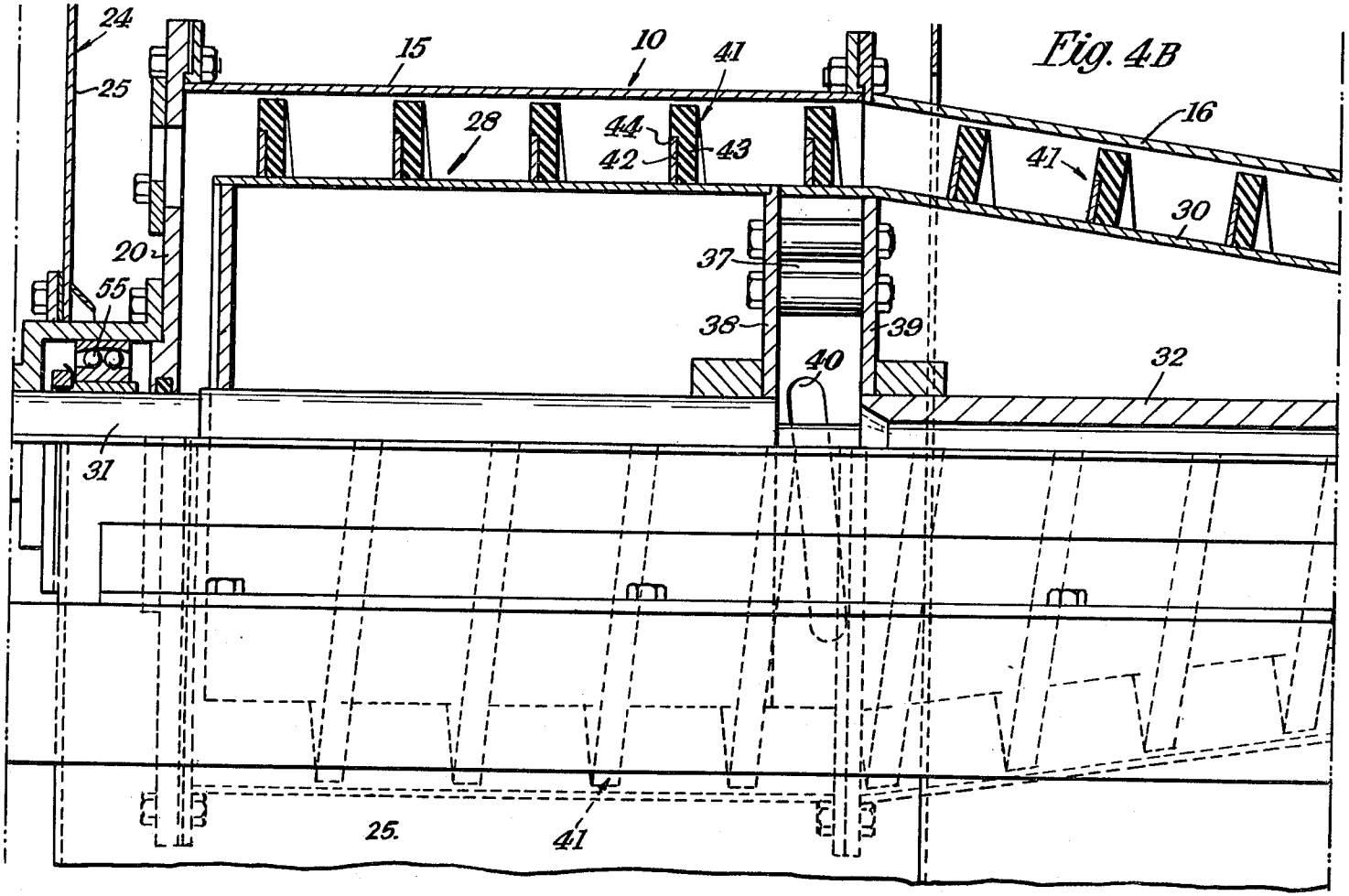
FIG. 4B is a continuation of the part sectional side elevation shown in FIG. 4A of a central portion B of the conveyer shown in FIG. 1.
Figure 4C:
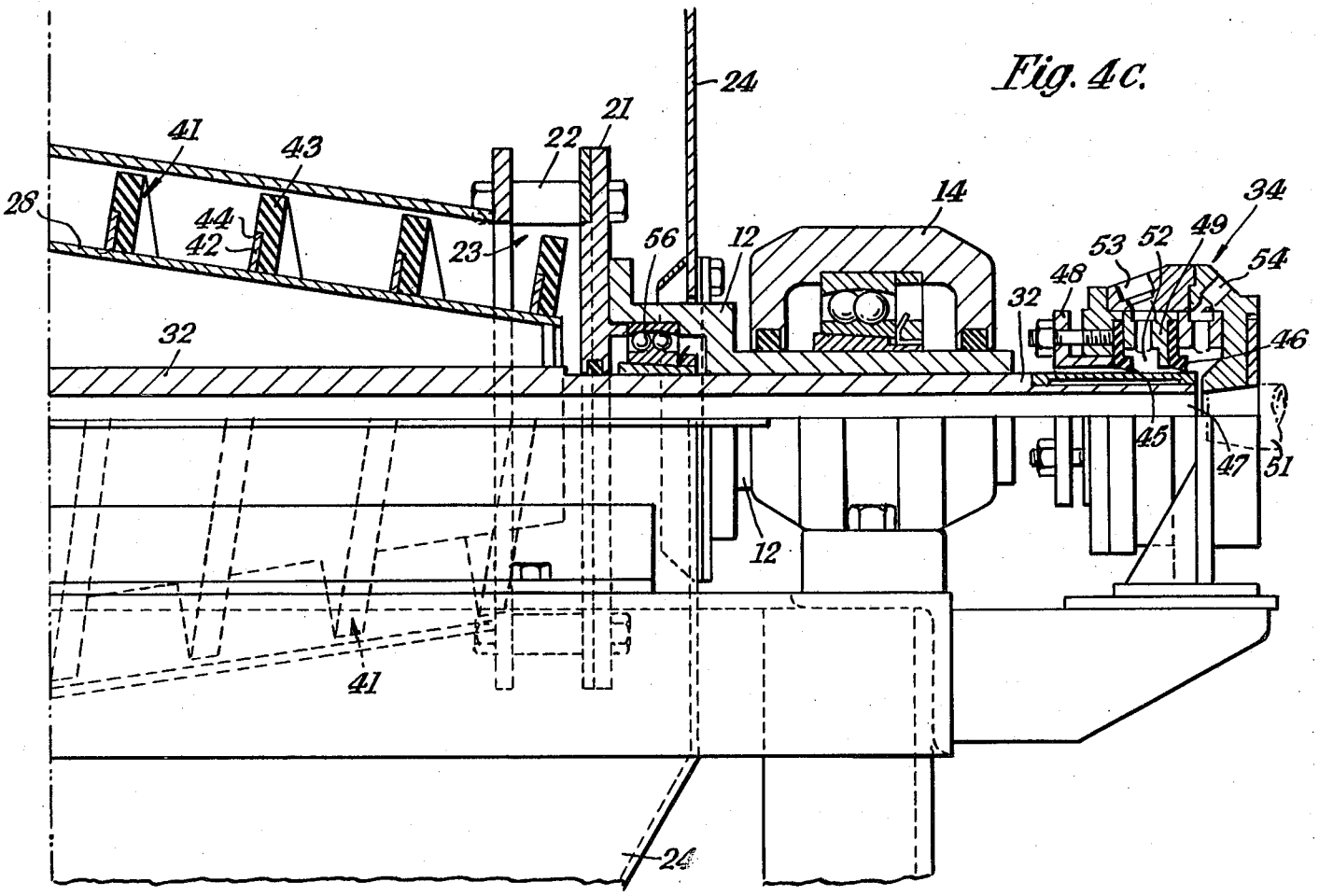
FIG. 4C is a continuation of the part sectional side elevation shown in FIG. 4B of a final portion C of the conveyer shown in FIG. 1.

Referring to FIG. 1 and FIGS. 4A, 4B and 4C the slurry centrifuge comprises a drum 10 mounted on stub shafts 11,12 and rotatable in bearings 13, 14 about a horizontal axis. The drum 10 comprises a right cylindrical portion 15 connected to a frusto-conical portion 16 which converges towards its axis as it extends away from the right cylindrical portion 15. One stub axle shaft 11 carries a pulley 17 engaged by a drive belt 18 driven by a motor 19 and tensioned by a jockey pulley (not shown). The end of the cylindrical portion 15 of the drum 10 is closed by a perforated plate 20 forming a liquid outlet and the end of the frusto-conical portion 16 of the drum 10 is spaced axially from an end plate 21 by spacers 22 to form a radially extending outlet 23 for liquid-reduced slurry sludge. The perforated plate 20 may be covered in a wear-resistant rubber material. The drum 10 is surrounded by a casing 24 divided into two sections: a liquid discharge section 25 surrounding the perforated plate 20 and having a discharge outlet 26, and a section 27 surrounding the sludge outlet 23 and having a sludge discharge. The outlets are covered by adjustable wear plates (not shown).

A scroll conveyer 28 is located within the drum 10 and comprises a right-cylindrical portion 29 connected to a frusto-conical portion 30 which converges towards the axis as it extends away from the right cylindrical portion 29, these portions of the conveyer 28 conform to the corresponding portions of the drum 10. The conveyer 28 is mounted on a stub shaft 31 at one end and on a slurry feed pipe 32 at the other end, the shaft 31 and feed pipe 32 being coaxial with and partially surrounded by the drum stub shafts 11,12. The conveyer 28 is rotatably supported by the drum 10 in bearings 55 and 56 and is also rotatable in a bearing 33 and a slurry inlet unit 34 described in more detail hereinafter. The stub shaft 31 carries a pulley 35 engaged by a drive belt 36 driven by the motor 19 and tensioned by a jockey pulley (not shown). The slurry feed pipe 32 extends from the slurry inlet unit 34 into the conveyer 28 where it communicates with a radial feed duct 37 formed by axially spaced radially extending plates 38 and 39, the radial feed duct 37 feeding slurry to the gap between the drum 10 and the conveyer 28 through an opening 40. The slurry feed pipe 32 and the radial feed duct 37 may be lined with a wear-resistant rubber material.

The conveyer 28 has a helical blade 41 extending around its outer surface. The blade 41 has a metal root portion covered by an elongate strip 43 of a wear-resistant rubber material. The strip 43 is of generally rectangular cross-section, one of the longer edges of the strip 43 being formed with a step 44 extending along the strip and having a depth and height normal to the length of the strip equal to the thickness and height of the blade 41 respectively, so that the blade 41 fits into the step 44 along the length of the strip 43. The strip 43 extends radially beyond the end of the root portion 42 and terminates adjacent the inner surface of the drum 10 and forms the working surface of the conveyer 28. It will be appreciated that the step may, if desired, be omitted and the strip be of regular rectangular cross-section.

The slurry inlet unit 34 comprises two annular seals 45 and 46 of a wear-resistant rubber material, which surround the slurry feed pipe 32 and contact the outer surface of the feed pipe 32 at axially spaced locations along the pipe 32 adjacent the open end 47 of the pipe 32. The radially extending ends of the seals 45 and 46 adjacent the pipe surface bear against respective annular rings 48 and 49 whose radially inner ends are spaced from the pipe surface and whose radially outer ends are connected to the inlet unit 34 surrounding the open end 47 for slurry feed through a non-rotatable pipe 51. The seals 45 and 46 are located closer to the open end 47 than their respective rings 48 and 49 and an annular chamber 52 is formed between the seals 45 and 46. An inlet 53 allows water under pressure to enter the chamber 52 and seep out between the ends of the seals 45 and 46 and the surface of the pipe 32. This action prevents slurry from passing beneath the seals 45 and 46 and lubricates the contact between seals 45 and 46 and the pipe surface. The rings 48 and 49 control the rate of seepage and the ring 48 is made adjustable in an axial direction as shown to allow variable control of the rate of water seepage.

The slurry inlet unit 34 also includes a flocculent inlet 54 for dosing the slurry with a flocculent such as a polyelectrolyte.

In use, the motor 19 rotates the drum 10 and the conveyer 28, with the conveyer 28 rotating slightly faster than the drum 10. As an example, a 25.40 cm. (10 inch) diameter drum is arranged to rotate at 1200 r.p.m. A slurry comprising about 20% solids content by weight is fed into the slurry feed pipe 32 through the slurry inlet unit 34 where it is dosed with a flocculent. The dosed slurry passes through the pipe 32, the radial duct portion 37 and the opening 40 into the gap between the conveyer 28 and the drum 10. Due to the drum speed, the solids in the slurry are flung onto the inner surface of the drum where they form a cake of solids with the solids-reduced liquid remaining on the top of the cake of solids. The difference in speed between the drum 10 and the conveyer 28 causes the cake of solids to be moved to the sludge outlet 23 where it discharges with a solids content of about 40% by weight. The solids-reduced liquid flows to the opposite end of the drum 10 where it discharges through the perforate plate 20 and the discharge outlet 26. The centrifuge operates with continuous feed and discharge.

The rubber on the blades of the conveyer 28 resists wear during movement of the sludge and increases the length of time for which the slurry centrifuge can be used before the blades require maintenance. The belt and pulley drive for the drum 10 and conveyer 28 provides for easy maintenance and obviates the need for gear boxes which require frequent attention.

The wear resistant rubber material employed in the slurry centrifuge hereinbefore described may with advantage be that as sold under our Registered Trade Mark "LINATEX".

The radial duct portion 37 in the embodiment hereinbefore described may if desired be replaced by a diametral duct of rectangular cross-section, the centre of which communicates with the pipe 32 and the outer ends of which are open to the space between the conveyer 28 and the drum 10.

I claim:

1. A centrifuge for separating a solids-liquid mixture comprising a rotatable drum having an inner surface of revolution about the rotary axis of the drum, a solids discharge outlet at one end of the drum and a liquid discharge outlet at the other end of the drum, means for feeding the solids-liquid mixture to a region adjacent the inner surface of the drum and a solids material conveyer arranged within the drum for rotation about the rotary axis of the drum at a speed slightly different from the speed of rotation of the drum and having a distal working surface formed about the rotary axis adjacent the inner surface of the drum and adapted to engage liquid-reduced solids material during rotation of the drum and the conveyer to convey it to the solids discharge outlet, while solids-reduced liquid discharges at the liquid discharge outlet at the other end of the drum, the distal working surface being provided at least in part by wear-resistant rubber material, and the means for feeding the solids-liquid mixture to the inner surface of the drum comprising a feed duct having an axial feed duct portion rotatable with the conveyer and extending along the rotary axis of the conveyer to an open end located outside the drum, wherein the open end of the axial feed duct portion communicates with a non-rotatable feed inlet which includes two non-rotatable annular seals of a wear-resistant rubber material surrounding the rotatable axial feed duct portion and engaging the outer surface thereof at axially spaced locations therealong adjacent the open end of the axial feed duct portion to form an annular chamber between the two seals and means for feeding to the chamber water under pressure whereby water seeps between the ends of the seals and the outer surface of the axial feed duct portion to lubricate the seals and to prevent the passage of the solids-liquid mixture beneath the seals.

2. A centrifuge according to claim 1, wherein the radially inner end of each seal bears against a non-rotatable annular ring, the radially inner edge of which is spaced from the outer surface of the axial feed duct portion, thereby to control the rate of seepage of water beneath the seals, the outer peripheries of the rings being connected to the non-rotatable feed inlet which surrounds the open end of the axial feed duct portion.

3. A centrifuge according to claim 2, wherein one or each of the rings is axially adjustable to vary the rate of water seepage beneath the associated seal.

4. A centrifuge according to claim 2, 3, or 1 comprising means for feeding to the inlet a flocculent for mixing with the solids-liquid mixture before it enters the axial feed duct portion.

5. A centrifuge according to claim 4 wherein the drum is fixedly mounted on a drive shaft coaxial with the rotary axis of the drum, wherein the drum is driven by drive means through a drive belt drivingly engaging a pulley fixedly mounted on the drive shaft, wherein the conveyer is fixedly mounted on a drive shaft coaxial with the rotary axis of the conveyer and wherein the conveyer is arranged to be driven by the drive means through a further drive belt drivingly engaging a further pulley on the drive shaft of the conveyer.

6. A centrifuge according to claim 5, wherein the drive belts are tensioned by jockey pulleys.

7. A centrifuge according to claim 6, wherein the drum includes a right cylindrical portion connected to a frusto-conical portion which converges toward the rotary axis as it extends away from the right cylindrical portion, wherein the liquid discharge outlet is provided at the outer end of the right cylindrical portion, and wherein the solids material discharge outlet is provided at the outer end of the frusto-conical portion.

8. A centrifuge according to claim 4, wherein the feed duct further comprises a radial feed duct portion which is rotatable with the conveyer and extends from the rotary axis of the conveyer to an outlet at the outer surface of the conveyer and wherein the axial feed duct portion communicates with and extends from the radially inner end of the radial feed duct portion.

9. A centrifuge according to claim 4, wherein the conveyer is a screw conveyer provided with a helical screw blade, wherein the distal working surface is formed by the surface of the screw blade facing the end of the drum provided with the solids discharge outlet, wherein the screw blade is formed by a metal root portion and a strip of the wear-resistant rubber material mounted on the root portion so as to present a working surface facing the end of the drum provided with the solids discharge outlet, wherein the strip of wear-resistant rubber material extends radially beyond the end of the root portion, terminates adjacent the inner surface of the drum, and is of generally rectangular cross-section with one of the longitudinal edges of the strip being formed with a step extending along the strip and having a height and depth normal to the length of the strip equal to the thickness and height of the root portion of the screw blade, the strip being so mounted on the root portion that the root portion fits into the step throughout the length of the strip.

10. A centrifuge according to claim 2, 3, or 1, wherein the conveyer is a screw conveyer provided with a helical screw blade, wherein the distal working surface is formed by the surface of the screw blade facing the end of the drum provided with the solids discharge outlet, wherein the screw blade is formed by a metal root portion and a strip of the wear-resistant rubber material mounted on the root portion so as to present a working surface facing the end of the drum provided with the solids discharge outlet, wherein the strip of wear-resistant rubber material extends radially beyond the end of the root portion, terminates adjacent the inner surface of the drum, and is of generally rectangular cross-section with one of the longitudinal edges of the strip being formed with a step extending along the strip and having a height and depth normal to the length of the strip equal to the thickness and height of the root portion of the screw blade, the strip being so mounted on the root portion that the root portion fits into the step throughout the length of the strip.

11. A centrifuge according to claim 2, 3, or 1, wherein the drum is fixedly mounted on a drive shaft coaxial with the rotary axis of the drum, wherein the drum is driven by drive means through a drive belt drivingly engaging a pulley fixedly mounted on the drive shaft, wherein the conveyer is fixedly mounted on a drive shaft coaxial with the rotary axis of the conveyer and wherein the conveyer is arranged to be driven by the drive means through a further drive belt drivingly engaging a further pulley on the drive shaft of the conveyer.

12. A centrifuge according to claim 11, wherein the drive belts are tensioned by jockey pulleys.

13. A centrifuge according to claim 2, 3, or 1, wherein the drum includes a right cylindrical portion connected to a frusto-conical portion which converges toward the rotary axis as it extends away from the right cylindrical portion, wherein the liquid discharge outlet is provided at the outer end of the right cylindrical portion, and wherein the solids material discharge outlet is provided at the outer end of the frusto-conical portion.

14. A centrifuge according to claim 2, 3, or 1, wherein solids material is separated from a slurry.

15. A centrifuge according to claim 2, 3, or 1, wherein the feed duct further comprises a radial feed duct portion which is rotatable with the conveyer and extends from the rotary axis of the conveyer to an outlet at the outer surface of the conveyer and wherein the axial feed duct portion communicates with and extends from the radially inner end of the radial feed duct portion.

16. A centrifuge according to claim 15, wherein the conveyer is a screw conveyer provided with a helical screw blade, wherein the distal working surface is formed by the surface of the screw blade facing the end of the drum provided with the solids discharge outlet, wherein the screw blade is formed by a metal root portion and a strip of the wear-resistant rubber material mounted on the root portion so as to present a working surface facing the end of the drum provided with the solids discharge outlet, wherein the strip of wear-resistant rubber material extends radially beyond the end of the root portion, terminates adjacent the inner surface of the drum, and is of generally rectangular cross-section with one of the longitudinal edges of the strip being formed with a step extending along the strip and having a height and depth normal to the length of the strip equal to the thickness and height of the root portion of the screw blade, the strip being so mounted on the root portion that the root portion fits into the step throughout the length of the strip.

17. A centrifuge according to claim 1, wherein the distal working surface on the conveyer extends helically about the rotary axis.

18. A centrifuge according to claim 17, wherein the conveyer is a screw conveyer provided with a helical screw blade and wherein the distal working surface is formed by the surface of the screw blade facing the end of the drum provided with the solids discharge outlet.

19. A centrifuge according to claim 18, wherein the screw blade is formed by a metal root portion and a strip of the wear-resistant rubber material mounted on the root portion so as to present a working surface facing the end of the drum provided with the solids discharge outlet.

20. A centrifuge according to claim 19, wherein the strip of wear-resistant rubber material extends radially beyond the end of the root portion and terminates adjacent the inner surface of the drum.

* * * * *